US009931564B2

(12) United States Patent
Murthy

(10) Patent No.: US 9,931,564 B2
(45) Date of Patent: Apr. 3, 2018

(54) TILE GAME APPARATUS AND METHOD

(71) Applicant: Nischal Murthy, Houston, TX (US)

(72) Inventor: Nischal Murthy, Houston, TX (US)

( * ) Notice: Subject to any disclaimer, the term of this patent is extended or adjusted under 35 U.S.C. 154(b) by 0 days.

(21) Appl. No.: 15/175,170

(22) Filed: Jun. 7, 2016

(65) Prior Publication Data

US 2017/0348591 A1 Dec. 7, 2017

Related U.S. Application Data

(60) Provisional application No. 62/172,619, filed on Jun. 8, 2015.

(51) Int. Cl.

| | |
|---|---|
| ***A63F 9/20*** | (2006.01) |
| ***A63F 9/06*** | (2006.01) |
| *A63F 3/00* | (2006.01) |

(52) U.S. Cl.

CPC ..... *A63F 9/20* (2013.01); *A63F 9/0669* (2013.01); *A63F 2003/00179* (2013.01); *A63F 2003/00182* (2013.01); *A63F 2003/00195* (2013.01); *A63F 2003/00766* (2013.01); *A63F 2003/00772* (2013.01); *A63F 2003/00785* (2013.01); *A63F 2003/00788* (2013.01); *A63F 2003/00791* (2013.01); *A63F 2009/068* (2013.01); *A63F 2009/0688* (2013.01); *A63F 2009/0694* (2013.01)

(58) Field of Classification Search

CPC ..... A63F 9/20; A63F 2003/00785; A63F 2003/00772; A63F 2003/00766; A63F 2003/00791; A63F 2003/00788; A63F 2003/00176; A63F 2003/00179; A63F 2003/00182; A63F 2003/00195

USPC ..... 273/283, 276, 275, 293, 294; D21/391

See application file for complete search history.

(56) References Cited

U.S. PATENT DOCUMENTS

| | | | | | |
|---|---|---|---|---|---|
| 139,928 | A * | 6/1873 | Stevens | A63F 9/20 | 273/294 |
| 214,048 | A * | 4/1879 | Macy | A63F 9/20 | 273/294 |
| 331,652 | A * | 12/1885 | Richards | A63F 9/20 | 273/294 |
| 377,832 | A * | 2/1888 | Kimball | A63F 1/02 | 273/293 |
| 1,362,318 | A * | 12/1920 | Hydes | A63F 9/20 | 273/153 R |
| 5,992,854 | A * | 11/1999 | Flory | A63F 1/00 | 273/138.1 |
| D587,321 | S * | 2/2009 | Patel | D21/391 | |
| 2013/0234388 | A1 * | 9/2013 | Dale | A63F 9/10 | 273/156 |

* cited by examiner

*Primary Examiner* — Benjamin Layno

(57) ABSTRACT

A game apparatus may include a plurality of polygonal tiles. Each tile may include a set of indicia positioned adjacent each side of the tile, and each set of indicia may include at least one pip, and at least one non-pip. Each side of a tile may include an identical number of indicia.

20 Claims, 6 Drawing Sheets

TILE GAME APPARATUS AND METHOD

CROSS-REFERENCE TO RELATED APPLICATIONS

This application claims priority under 35 USC § 119 to U.S. Provisional Patent Application Ser. No. 62/172,619 filed on Jun. 8, 2015.

BACKGROUND

The present invention relates to an apparatus for a tile game. More particularly, the present invention relates to an apparatus for a polygonal tile game.

Several known tile games include domino tile games that use a plurality of dominos. In the original domino game, each domino may be generally rectangular shaped, and may include two sets of indicia, one on each side of the domino. The indicia may range from one to six dots in the traditional game, and may range from one to twelve dots in a "Mexican train" version of dominos. In one method of play, several players each select a predetermined number of dominoes and take turns playing one domino at a time so that at least one indicia of their domino is adjacent and identical to the indicia of a previously played domino. Other geometries of tile games include triangles and hexagons, with similar methods of play.

In such prior art, the complexity of the games and the skill required to play the games have been minimal. In addition, the indicia patterns in the previous tile games have only required minimal logic to derive a set of tiles for game play.

What is needed, then, is an apparatus for deriving tiles with indicia and methods of playing with such tiles that addresses the issues discussed above.

SUMMARY

In one embodiment of the present invention, a game apparatus may include a plurality of polygonal tiles. Each tile may include a set of indicia positioned adjacent each side of the tile, and each set of indicia may include at least one pip, and at least one non-pip. Each side of the tile may include an identical number of indicia.

In one embodiment of the present invention, a game apparatus may include a plurality of hexagonal tiles. Each hexagonal tile may include a set of five indicia positioned adjacent each side of the tile, and each set of indicia may include at least one pip and at least one non-pip.

In one embodiment of the present invention, a game apparatus may include a plurality of square tiles. Each square tile may include a set of four indicia positioned adjacent each side of the tile, and each set of indicia may include at least one pip and at least one non-pip.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
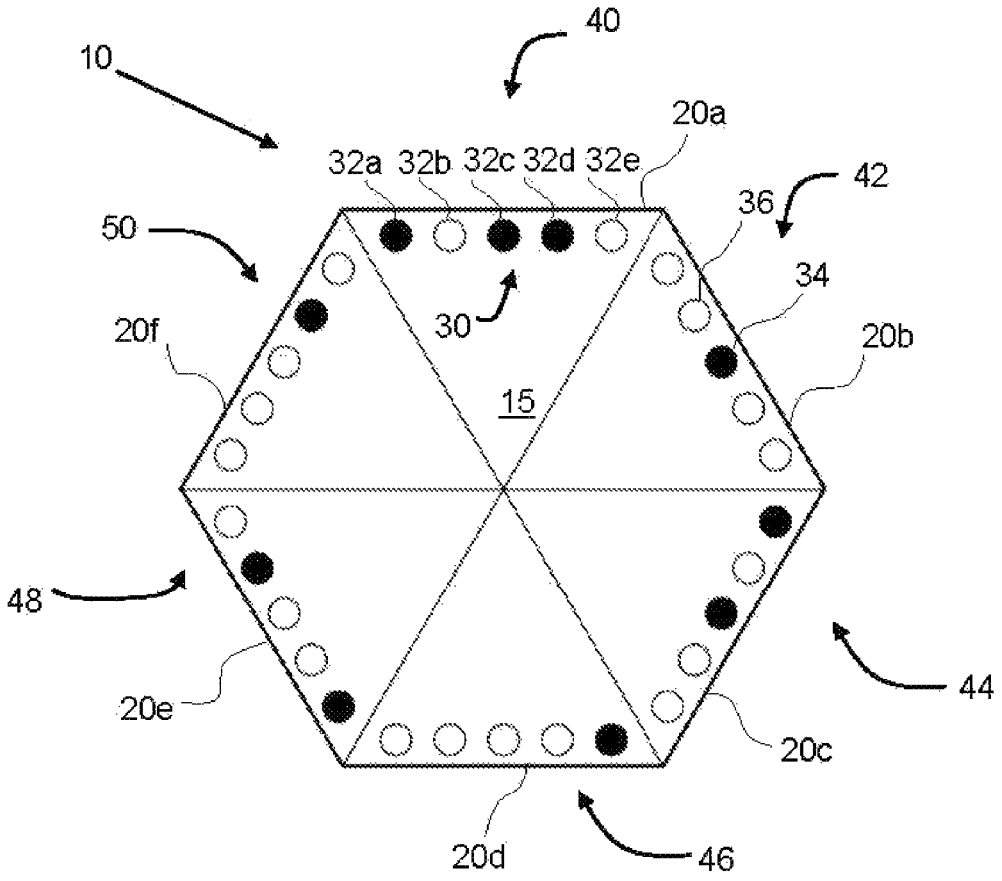
FIG. 1 is a schematic of a hexagon-shaped tile for a game apparatus, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. It should also be appreciated that the term "about," as used herein, in conjunction with a numeral refers to a value that is +/−5% (inclusive) of that numeral, +/−10% (inclusive) of that numeral, or +/−15% (inclusive) of that numeral. It should further be appreciated that when a numerical range is disclosed herein, any numerical value falling within the range is also specifically disclosed. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 3:
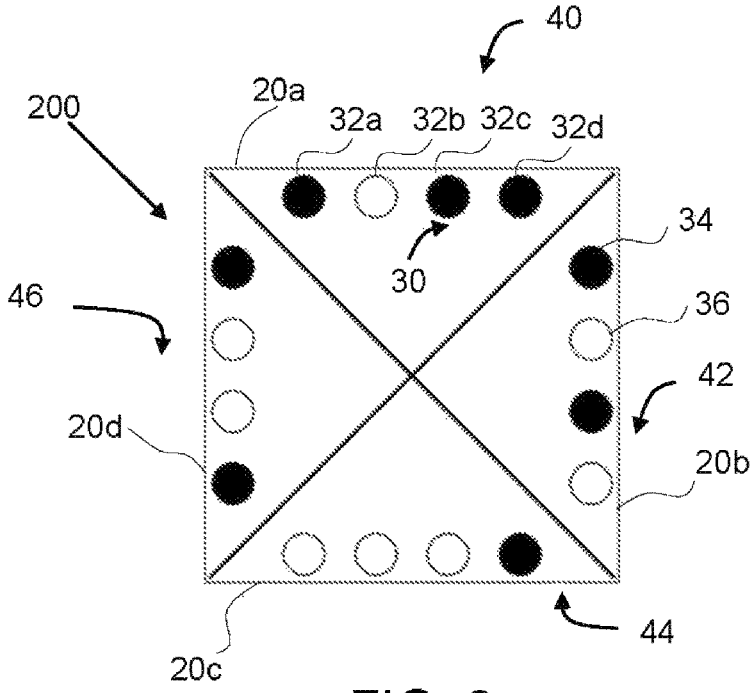
FIG. 3 is a schematic of a square-shaped tile for a game apparatus, according to one or more embodiments disclosed.
Figure 4:
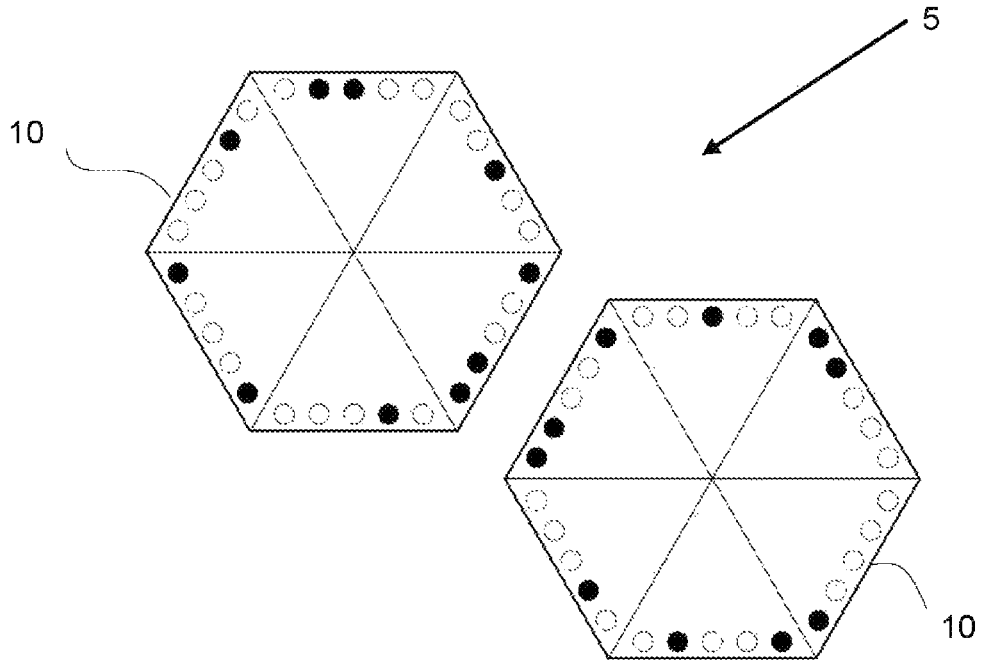
FIG. 4 is a schematic of a plurality of hexagon-shaped tiles that are aligned for a game apparatus, according to one or more embodiments disclosed.

Embodiments of the disclosure generally provide a game apparatus 5, first shown in FIG. 4, that includes a plurality of polygonal tiles 10, 100, 200, as shown in FIGS. 4-9. The polygonal tiles 10, 100, 200 may be any shape such as the hexagon-shaped tile 10 shown in FIG. 1, the triangle-shaped tile 100 shown in FIG. 2, or the square-shaped tile 200 shown in FIG. 3. The plurality of polygonal tiles 10, 100, 200 in the game apparatus 5 may all be identical in shape to allow for tessellation of a planar surface. In an alternative embodiment, the plurality of polygonal tiles 10, 100, 200 in the game apparatus 5 may include multiple shapes that allow for tessellation of a planar surface.

Furthermore, while various polygonal shapes are disclosed herein, the presently claimed subject matter is not limited to those disclosed shapes. The polygonal tiles 10, 100, 200 of any given game apparatus 5 may be any piece planar on at least one of its obverse and reverse sides and having three or more sides. Still further, while the sides of the polygonal shapes herein are all shown as being straight or planar, other contours may also be used so long as the tiles 10, 100, 200 can mate with one another and either be tessalated across a planar surface or stacked as described further below.

FIG. 1 is a detailed schematic of a hexagon-shaped tile 10 for a game apparatus 5, according to one or more embodiments disclosed. As shown in FIG. 1, the tile 10 may include sides 20*a-f*, and the sides 20*a-f* of the tile 10 may be equilateral to allow for tessellation of a planar surface when the sides 20*a-f* of several tiles 10 are aligned. In an alternative embodiment, the sides 20*a-f* of the tile 10 may not be equilateral and still allow for tessellation of a planar surface. The tile 10 may include a first face 15 and a second face 17 (not shown). On the first face 15 of the tile 10, a set 30 of indicia 32 may be positioned adjacent each side 20*a-f*. It is also contemplated that a set 30 of indicia 32 may be positioned adjacent each side 20*a-f* on the second face 17 of the tile 10. The set 30 of indicia 32*a-e* on each side 20*a-f* may include an identical number of indicia 32 on each tile 10 within the game apparatus 5. In an alternative embodiment, different numbers of indicia 32 may appear on each tile 10 within the game apparatus 5. In FIG. 1, the set 30 of indicia 32 includes five indicia 32*a-e*, however it is contemplated that any number of indicia 32 could be used. The indicia 32*a-e* of each set 30 of indicia 32 may form a straight line along the sides 20*a-f* of the tile 10, and the indicia 32*a-e* may be evenly spaced along each side 20*a-f* of the tile 10. However, other indicia 32 formations are contemplated. For example, in one embodiment, and as shown in FIG. 4, the indicia 32*a-e* may be positioned in identical locations adjacent each side 20*a-f* of each tile 10, such that when the sides 20*a-f* of several tiles 10 are aligned, the indicia 32*a-e* may be positioned parallel to one another. The indicia 32*a-e* may be affixed, engraved, or otherwise formed adjacent each side 20*a-f* on or in the surface 15 of the tile 10.

The indicia 32*a-e* may consist of a specific shape, such as a circle shown in FIG. 1. However, other shapes or markings for the indicia 32*a-e* are contemplated within this disclosure, including, but not limited to, a square or a diamond. Further, the indicia 32*a-e* may consist of various pictures, such as an apple or an orange for example. The indicia 32*a-e* may include at least one pip 34 and at least one non-pip 36. The pips 34 may be a filled-in indicia 32, as indicated by the indicia 32*a*, 32*c*, and 32*d*, and the non-pips 36 may be blank indicia 32, as indicated by the indicia 32*b* and 32*e* of FIG. 1. In one embodiment, the pips 34 and the non-pips 36 may be indicated by different colored indicia 32, such as blue for the pips 34 and red for the non-pips 36. In yet another embodiment, the pips 34 and the non-pips 36 may be indicated by different pictures or characters, such as cats for the pips 34 and dogs for the non-pips 36. The invention contemplates that any visually distinguishable feature may be used to delineate between pips 34 and non-pips 36.

In an exemplary embodiment, the positioning of the pips 34 and the non-pips 36 adjacent each side 20*a-f* of the tile 10 may be derived from the positioning of the pips 34 and the non-pips 36 along the first side 20*a*, or primary side, of the tile 10. For ease of understanding various methods of deriving sets of indicia 30 along the sides 20*a-f* of a given tile 10, the sides 20*b-f* will be explained via its relationship to the first side 20*a* of the tile 10 via counterclockwise rotation, with the indicia 32*a-e* being read from left to right after such counterclockwise rotation on each side 20*a-f*. Accordingly, the second side 20*b* is adjacent the first side 20*a*, the third side 20*c* is adjacent the second side 20*b*, the fourth side 20*d* is adjacent the third side 20*c*, the fifth side 20*e* is adjacent the fourth side 20*d*, and the sixth side 20*f* is adjacent the fifth side 20*e* and the first side 20*a*. Further, the indicium 32*a* is in position one, the indicium 32*b* is in position two, the indicium 32*c* is in position three, the indicium 32*d* is in position four, and the indicium 32*e* is in position five along the side 20*a* of the tile 10, such that the positioning of the set of 30 indicia 32 along the first side 20*a* may be described as {1, 2, 3, 4, 5}.

A set of pips 32 may also be described in relation to their position within the set 30 of indicia 32, and may therefore include a subset of the set 30 of indicia 32. For example, in FIG. 1, a first set 40 of pips 34 may include the set 40 of pips 34 along the first side 20*a* of the tile 10. In FIG. 1, the first set 40 of pips 34 may be described as {1, 3, 4}, such that the pips 34 are positioned in position one (32*a*), position three (32*c*), and position four (32*d*). Similarly, a second set 42 of pips 34 may include the set 42 of pips 34 along the second side 20*b* of the tile 10. In FIG. 1, the second set 42 of pips 34 may be described as {3}. A third set 44 of pips 34 may include the set 44 of pips 34 along the third side 20*c* of the tile 10. In FIG. 1, the third set 44 of pips 34 may be described as {1, 3}. A fourth set 46 of pips 34 may include the set 46 of pips 34 along the fourth side 20*d* of the tile 10. In FIG. 1, the fourth set 46 of pips 34 may be described as {1}. A fifth set 48 of pips 34 may include the set 48 of pips 34 along the fifth side 20*e* of the tile 10. In FIG. 1, the fifth set 48 of pips 34 may be described as {1, 4}. And, a sixth set 50 of pips 34 may include the set 50 of pips 34 along the sixth side 20*f* of the tile 10. In FIG. 1, the sixth set 50 of pips 34 may be described as {4}.

In one embodiment, a method of deriving a set of pips 34 for each side 20*a-f* of the tile 10 may be based on a subtraction method. Using the subtraction method, the second, third, fourth, fifth, and sixth sets 42, 44, 46, 48, 50 of pips 34 may be a subset of the first set 40 of pips 34.

In one embodiment, a method of deriving a set of pips 34 for each side 20*a-f* of the tile 10 may be based on a complementation method. Using the complementation method, the second, third, fourth, fifth, and sixth sets 42, 44, 46, 50 of pips 34 may be a relative complement of the first set of pips 40 with respect to the set 30 of indicia 32.

In one embodiment, a method of deriving a set of pips 34 for each side 20*a-f* of the tile 10 may be based on an addition method. Using the addition method, the second, third, fourth, fifth, and sixth sets 42, 44, 46, 48, 50 of pips 34 may be equivalent to the first set 40 of pips 34 in union with a non-empty subset of the relative complement of the first set 40 of pips 34 with respect to the set 30 of indicia 32.

In one embodiment, a method of deriving a set of pips 34 for each side 20*a-f* of the tile 10 may be based on a substitution method. Using the substitution method, the addition and subtraction methods described above may be combined, with the restriction that the number of elements added and the number of elements subtracted are equal. Further, any of the above described methods may be combined to derive a set of pips 34 for each side 20*a-f* of the tile 10.

In one embodiment, an exemplary method of deriving a set of pips 34 for each side 20*a-f* of the hexagonal tile 10, as shown in FIG. 1, may be based on a mathematical logic system. Such logic system may include sets of indicia 32 that may consist of five indicia 32 along each side 20*a-f* of the tile 10. The first side 20*a* may include three pips 34, which forms the first set 40 of pips 34, as shown in FIG. 1. The third set 44 of pips 34 of the third side 20*c* and the fifth set 48 of pips 34 of the fifth side 20*e* may include a subset of the first set 40 of pips 34. The third set 44 of pips 34 and the fifth set 48 of pips 34 may have a cardinality (or set) of two pips 34. In addition, the third set 44 of pips 34 and the fifth side set 48 of pips 34 may have a cardinality of one pip 34 when the third set 44 of pips 34 intersects the fifth set 48 of pips 34. The fourth side 20*d* may include the fourth set 46 of pips 34 that includes the intersection of the third set 44 of pips 34 and the fifth set 48 of pips 34. Accordingly, the fourth set 46 of pips 34 may have a cardinality of one pip 34. The second side 20*b* may include the second set 42 of pips 34 that may be derived from a relative complement of the fourth set 46 of pips 34 in the third set 44 of pips 34. Accordingly, the cardinality of the second set 42 of pips 34 may be one. The sixth side 20*f* may include the sixth set 50 of pips 34 that may be derived from a relative complement of the fourth set 46 of pips 34 in the fifth set 48 of pips 34. Accordingly, the cardinality of the sixth set 50 of pips 34 may be one.

Figure 7:
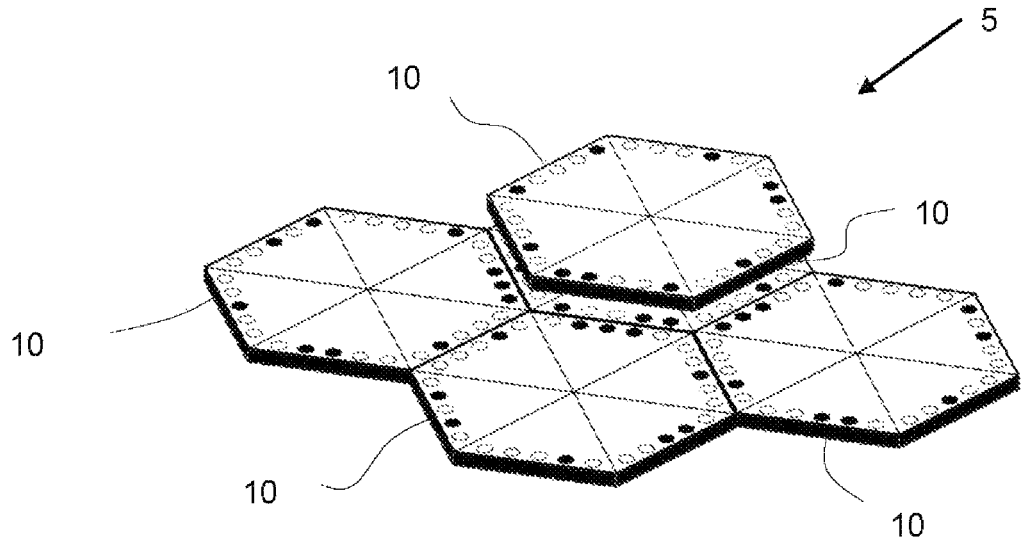
FIG. 7 is a schematic of a plurality of hexagon-shaped tiles that are stacked for a game apparatus, according to one or more embodiments disclosed.

Per the above described method of deriving the sets of pips 34 for hexagonal tiles 10, the game apparatus 5 may include a set of sixty hexagonal tiles 10 with all possible sets of pips 34 along each side 20*a-f* exhausted, and no repetition between each tile 10. FIG. 7 depicts a table showing a distribution of the pips 34 along each side 20*a-f* for the sixty hexagonal tiles 10, as derived by the aforementioned method. The pips 34 and non-pips 36 are shown in binary format as they may be represented as a set 30 of indicia 32, where the pips 34 are represented by the number "1" and the non-pips 36 are represented by the number "0". Further, the first side 20*a* is represented as "Edge-0", the second side 20*b* is represented as "Edge-1", and so forth.

Figure 2:
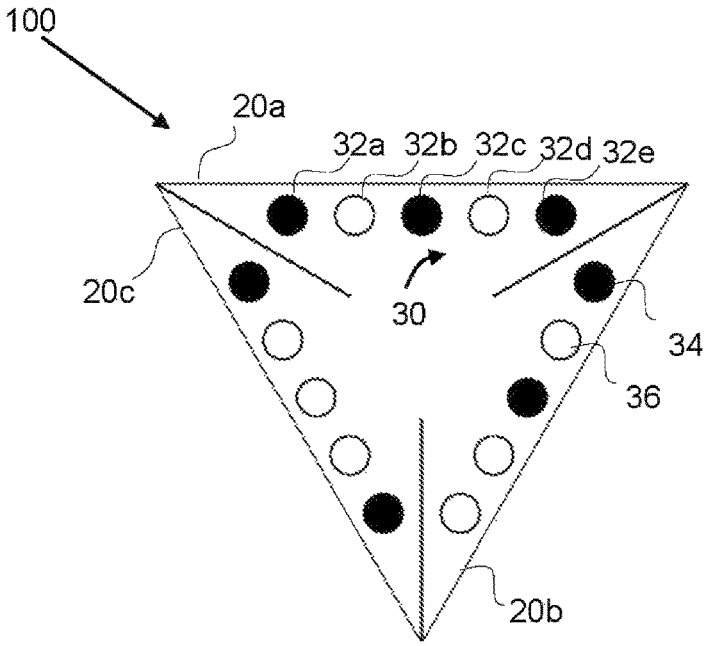
FIG. 2 is a schematic of a triangle-shaped tile for a game apparatus, according to one or more embodiments disclosed.
Figure 5:
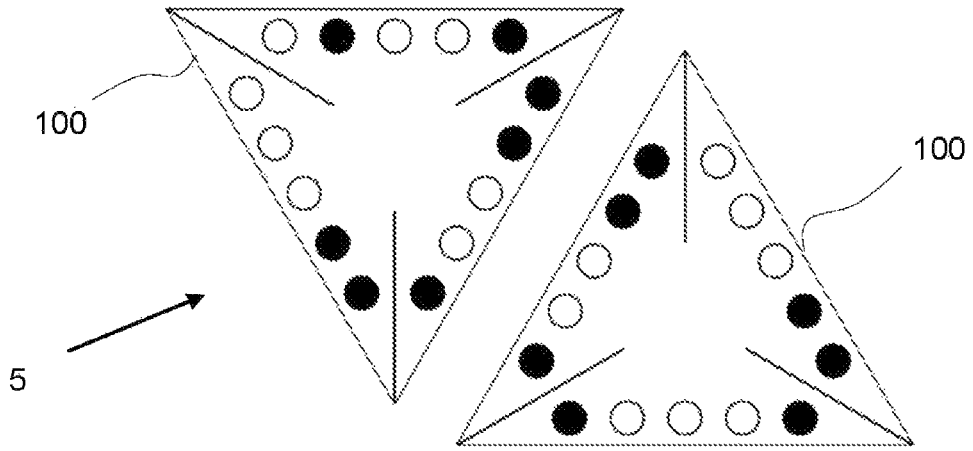
FIG. 5 is a schematic of a plurality of triangle-shaped tiles that are aligned for a game apparatus, according to one or more embodiments disclosed.

FIG. 2 is a schematic of a triangle-shaped tile 100 for a game apparatus 5, according to one or more embodiments disclosed. The tile 100 may include sides 20*a-c*. In one embodiment, the sides 20*a-c* may be equilateral so that a plurality of tiles 100 may be aligned to provide tessellation of a planar surface, as shown in FIG. 5. In an alternative embodiment, the sides 20*a-c* of the tiles 100 may not be equilateral. The tiles 100 may include sets 30 of indicia 32, which may include any number of indicia 32, along each side 20*a-c*. Any of the above described methods of deriving the sets of pips 30 along the sides 20*a-c* may be used to derive the sets of pips along each side 20*a-c* of the tiles 100.

Figure 6:
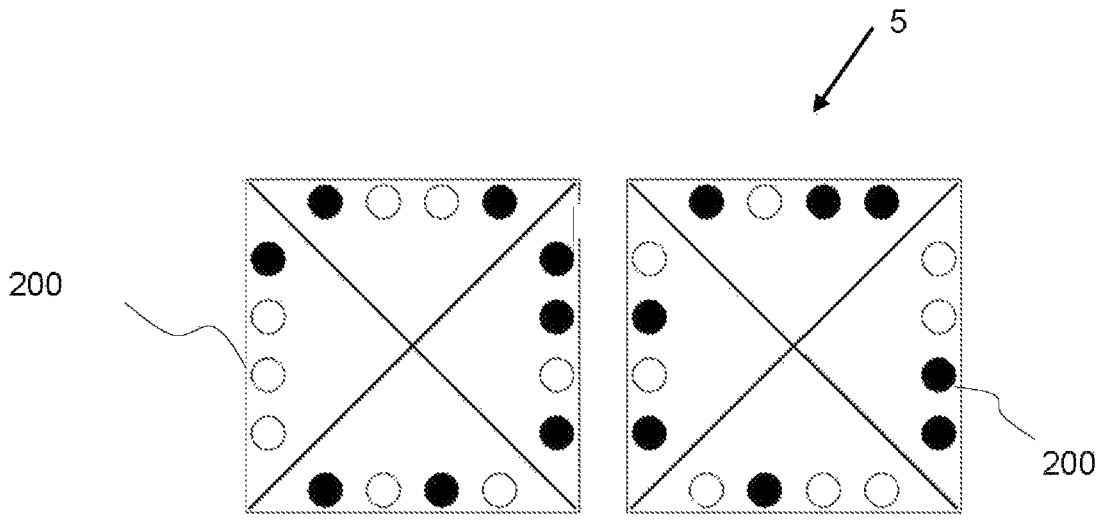
FIG. 6 is a schematic of a plurality of square-shaped tiles that are aligned for a game apparatus, according to one or more embodiments disclosed.

FIG. 3 is a schematic of a square-shaped tile 200 for a game apparatus 5, according to one or more embodiments disclosed. The tile 200 may include sides 20*a-d*. In one embodiment, a plurality of tiles 200 may be aligned to provide tessellation of a planar surface, as shown in FIG. 6. The tiles 200 may include sets 30 of indicia 32, which may include any number of indicia 32, along each side 20*a-d*. Further, any of the above described methods of deriving the sets of pips 30 along the sides 20*a-d* may be used to derive the sets of pips along each side 20*a-d* of the tiles 200.

In one embodiment, an exemplary method of deriving a set of pips 34 for each side 20*a-d* of the square tile 200, as shown in FIG. 3, may be based on a mathematical logic system. Such logic system may include sets 30 of indicia 32 that may consist of four indicia 32*a-d* along each side 20*a-f* of the tile 200. The first side 20*a* may include three pips 34, which forms the first set 40 of pips 34, as shown in FIG. 3. The second set 42 of pips 34 and the fourth set 46 of pips 34 may be a subset of the first set 40 of pips 34, and the second set 42 of pips 34 and the fourth set 46 of pips 34 may have a cardinality of two. Further, the second set 42 of pips 34 and the fourth set 46 of pips 34 may have a cardinality of one when the second set 42 of pips 34 and the fourth set 46 of pips 34 intersect. The third set 44 of pips 34 may be the intersection of the second set 42 of pips 34 and the fourth set 46 of pips 34. Per the above described method of deriving the sets of pips 34 for each side 20*a-d* of a square tile 200, the game apparatus 5 may include a set of twenty-four square tiles 200 with all possible sets of pips 34 along each side 20*a-d* exhausted, and no repetition between each tile 200.

Figure 8:
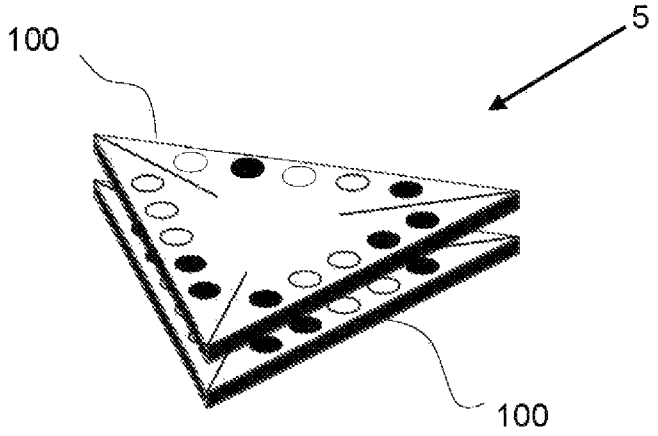
FIG. 8 is a schematic of a plurality of triangle-shaped tiles that are stacked for a game apparatus, according to one or more embodiments disclosed.
Figure 9:
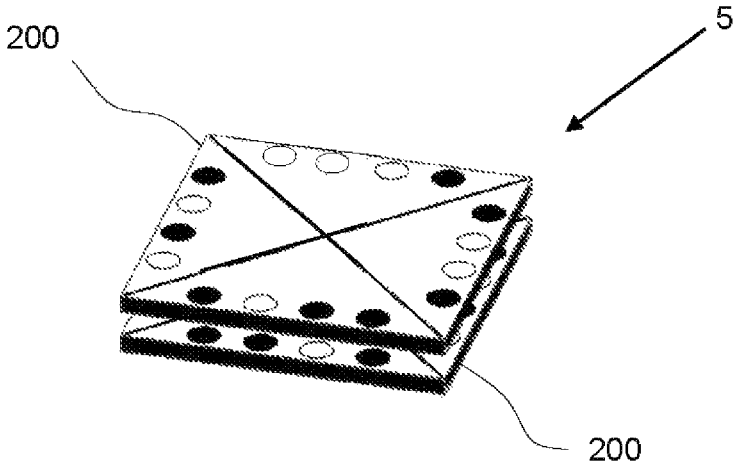
FIG. 9 is a schematic of a plurality of square-shaped tiles that are stacked for a game apparatus, according to one or more embodiments disclosed.
Figure 10:
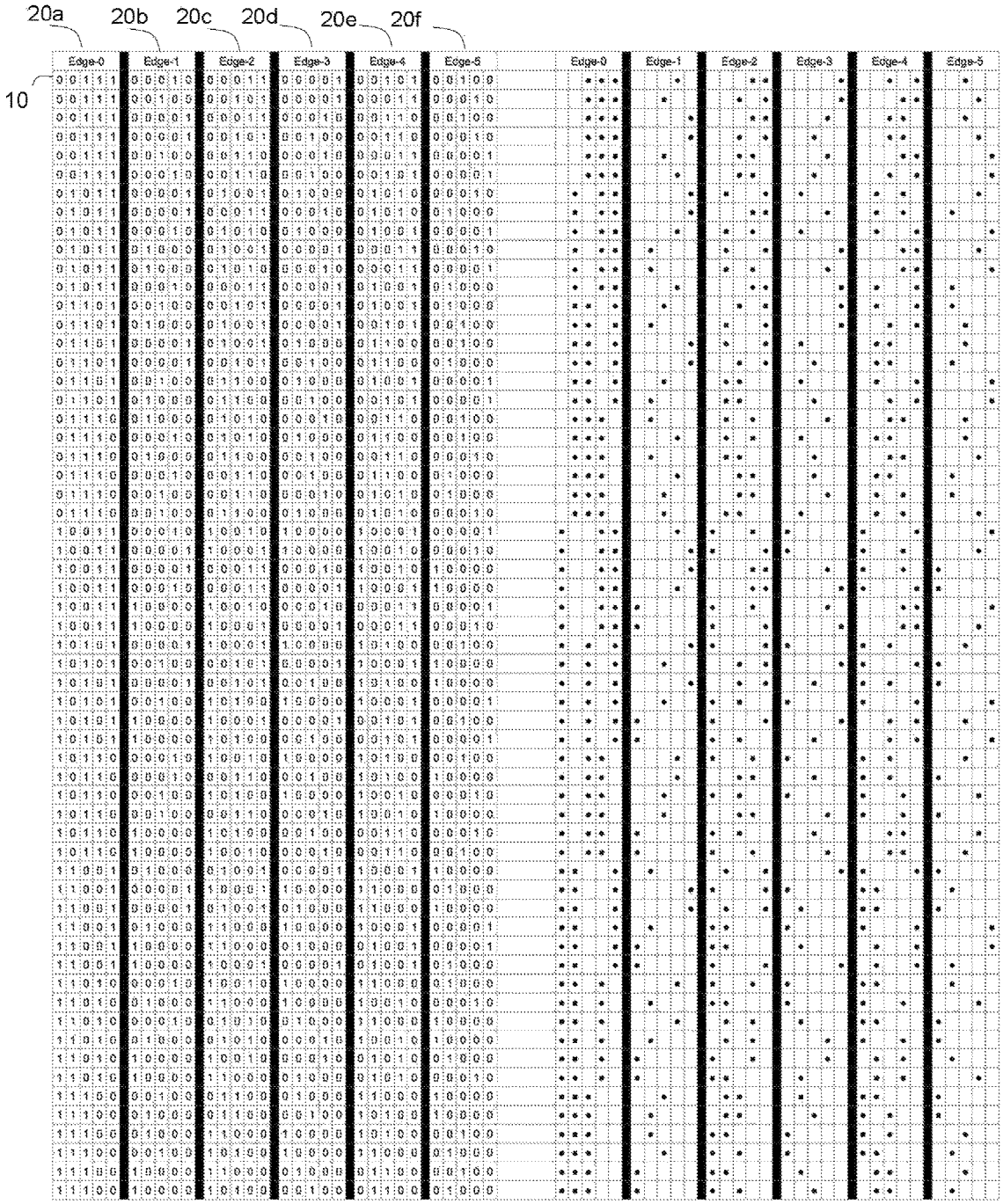
FIG. 10 is a table showing sets of indicia for a plurality of hexagon-shaped tiles for a game apparatus, according to one or more embodiments disclosed.

Turning to methods of using the game apparatus 5, in one embodiment, the sides 20*a-f* of the tiles 10, 100, 200 may be aligned, as shown in FIGS. 4-6, respectively. In one embodiment, one or more of the pips 34 may be aligned. In one embodiment, the tiles 10, 100, 200 may be positioned proximal to one another such that a planar surface may be tessellated. In one embodiment, the tiles 10, 100, 200 may be stacked, as shown in FIGS. 7-9, respectively. Further, a method of using the game apparatus 5 may include both positioning the tiles 10, 100, 200 proximal to one another as well as stacking the tiles 10, 100, 200, as shown in FIG. 7. In one embodiment, one or more tiles 10, 100, 200 may be rotated about the center of the face 15 of the individual tile 10, 100, 200 during gameplay. In addition, the tiles 10, 100, 200 may be flipped to switch positions between the first face 15 and the second face 17.

In one embodiment of a method of gameplay using the game apparatus 5, players may draw a plurality of tiles 10, 100, 200 to form a hand and the players may take turns playing one tile 10, 100, 200 out of their hand. The players may align the sides 20*a-f* of the tiles 10, 100, 200 adjacent one another on a playing surface. Points may be awarded to the player aligning the pips 34 along adjacent sides 20*a-f* of the tiles 10, 100, 200.

In another embodiment of a method of gameplay using the game apparatus 5, players may draw a plurality of tiles 10, 100, 200 to form a hand and the players may take turns playing one tile 10, 100, 200 out of their hand. The players may align the sides 20*a-f* of the tiles 10, 100, 200 out of their hand only if the number of pips 34 on the placed tile 10, 100, 200 adjacent to those on the playing surface is exactly two. Points may be awarded to the player placing the new tile 10, 100, 200 equal to the number of tiles 10, 100, 200 adjacent to the played tile 10, 100, 200 at the time of play.

In another embodiment of gameplay using the game apparatus 5, four players may be placed on two teams, with players on the same team on opposite sides of the playing surface. On a player's turn, the player's partner may rotate a tile 10, 100, 200 on the playing surface with some restrictions. Once the rotation is complete, the player whose turn it is places a tile 10, 100, 200 from their hand adjacent to one or more tiles 10, 100, 200 on the playing surface. Points may be awarded to the player's team for each pair of pips aligned along adjacent sides 20*a-f*.

In one embodiment of gameplay using the game apparatus 5, players play hands including a plurality of tiles 10, 100, 200 and take turns placing the tiles 10, 100, 200 adjacent to one or more tiles 10, 100, 200 or on top of one tile 10, 100, 200 of the playing surface. Tiles 10, 100, 200 may be placed on top of another tile 10, 100, 200 which has a minimum of three tiles 10, 100, 200 adjacent at its own vertical level. Points may be awarded to the player placing the new tile 10, 100, 200 based on each pair of pips 34 aligned along adjacent sides 20*a-f*.

In one embodiment of gameplay using the game apparatus 5, players play hands including a plurality of tiles 10, 100, 200 and take turns placing the tiles 10, 100, 200 adjacent to one or more tiles 10, 100, 200 on a playing surface. Points may be awarded to the player placing the new tile 10, 100, 200 based on each pair of pips 34 aligned along adjacent sides 20*a-f*. Prior to a new player's turn, any player may "blackout" the current player's tile 10, 100, 200 placement by placing previously designated blackout tiles 10, 100, 200 face down on top of the played tile 10, 100, 200. The placement of a blackout tile 10, 100, 200 on top of the played tile 10, 100, 200 nullifies the current player's turn and renders the blackout tile 10, 100, 200 portion of a tile arrangement unusable.

In another embodiment of gameplay using the game apparatus 5, players play hands including a plurality of tiles 10, 100, 200 and take turns placing the tiles 10, 100, 200 adjacent to one or more tiles 10, 100, 200 on a playing surface. Points may be awarded to the player placing the new tile 10, 100, 200 based on each pair of pips 34 aligned along adjacent sides 20*a-f*. Upon each tenth tile 10, 100, 200 played, all tiles 10, 100, 200 on an outer side 20*a-f* of the tile arrangement may be rotated. For example, when playing with hexagonal tiles 10, the tiles may be rotated by a $1/6^{th}$ rotation.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A game apparatus, comprising:

a plurality of polygonal tiles, wherein each polygonal tile includes a set of indicia positioned adjacent each side of the tile, and each set of indicia on each side of the tile comprises:

indicia representing at least one pip, and indicia representing at least one non-pip, wherein indicia representing at least one pip is visually distinguishable from indicia representing at least one non-pip and wherein each side includes an identical number of indicia.

2. The game apparatus of claim 1, wherein each set of indicia form a straight line along the side of the tile and the indicia in each set are evenly spaced along the sides.

3. The game apparatus of claim 1, wherein the indicia are positioned in identical locations along each side of each tile.

4. The game apparatus of claim 1, wherein the polygonal tiles are triangle, square or hexagon shaped.

5. The game apparatus of claim 1, wherein the positioning of the pips and the non-pips on sides of the tile is derived from the positioning of the pips along a first side of the tile.

6. The game apparatus of claim 5, wherein the pips' position among the indicia along the first side forms a first set of pips.

7. The game apparatus of claim 6, wherein sets of pips for each side, excluding the first set of pips along the first side, are derived by using a subtraction method based on the first set of pips.

8. The game apparatus of claim 6, wherein sets of pips for each side, excluding the first set of pips along the first side, are derived by using a complementation method based on the first set of pips.

9. The game apparatus of claim 6, wherein sets of pips for each side, excluding the first set of pips along the first side, are derived by using an addition method based on the first set of pips.

10. The game apparatus of claim 6, wherein:

the polygonal tiles are hexagon shaped;

the positioning of pips along a third and fifth side of the tile is derived from a subset of the first set of pips, the number of pips along the third and fifth sides are two and the pips position in the indicia along the third and fifth sides forms a third and fifth set of pips, respectively, and wherein the intersection of the third set of pips and fifth set of pips has a cardinality of one;

the positioning of pips along the fourth side of the tile is derived from an intersection of the third set of pips and the fifth set of pips, the number of pips along the fourth side is one and the pips position in the indicia along the fourth side forms a fourth set of pips;

the positioning of pips along the second side is derived from a relative complement of the fourth set of pips in the third set of pips, and the number of pips along the second side is one; and the positioning of pips along the sixth side is derived from a relative complement of the fourth set of pips in the fifth set of pips, and the number of pips along the sixth side is one.

11. A game apparatus, comprising:

a plurality of hexagonal tiles, wherein each hexagonal tile includes a set of five indicia positioned adjacent each side of the tile, and each set of indicia includes indicia representing at least one pip and indicia representing at least one non-pip wherein indicia representing at least one pip is visually distinguishable from indicia representing at least one non-pip, and wherein each side includes an identical number of indicia.

12. The game apparatus of claim 11, wherein a first side includes three pips and two non-pips.

13. The game apparatus of claim 12, wherein a third side and a fifth side each include two pips and three non-pips.

14. The game apparatus of claim 13, wherein a second side, a fourth side, and a sixth side each include one pip and four non-pips.

15. The game apparatus of claim 14, wherein the game apparatus comprises sixty tiles with no repetition.

16. A game apparatus, comprising:

a plurality of square tiles, wherein each tile includes a set of four indicia positioned adjacent each side of the tile, and each set of indicia comprises indicia representing at least one pip and indicia representing at least one non-pip wherein indicia representing at least one pip is visually distinguishable from indicia representing at least one non-pip, and wherein each side includes an identical number of indicia.

17. The game apparatus of claim 16, wherein a first side includes three pips and one non-pip.

18. The game apparatus of claim 17, wherein a second side and a fourth side each include two pips and two non-pips.

19. The game apparatus of claim 18, wherein a third side includes one pip and three non-pips.

20. The game apparatus of claim 19, wherein the game apparatus comprises twenty-four tiles with no repetition.

* * * * *